US007123225B2

(12) United States Patent
Chen

(10) Patent No.: US 7,123,225 B2
(45) Date of Patent: Oct. 17, 2006

(54) METHOD OF DRIVING ACTIVE MATRIX LIQUID CRYSTAL DISPLAY FOR RESTRAINING IMAGE STICKING

(75) Inventor: Po-Lun Chen, Chia Yi (TW)

(73) Assignee: AU Optronics Corp., Hsinchu (TW)

( * ) Notice: Subject to any disclaimer, the term of this patent is extended or adjusted under 35 U.S.C. 154(b) by 314 days.

(21) Appl. No.: 10/428,111

(22) Filed: May 2, 2003

(65) Prior Publication Data

US 2004/0178982 A1 Sep. 16, 2004

(30) Foreign Application Priority Data

Mar. 14, 2003 (TW) ..... 92105648

(51) Int. Cl.
*G09G 3/36* (2006.01)

(52) U.S. Cl. ..... 345/89; 345/55; 345/204; 345/208; 345/209; 345/212

(58) Field of Classification Search ..... 345/89, 345/55, 204, 208–209, 212
See application file for complete search history.

(56) References Cited

U.S. PATENT DOCUMENTS

2002/0140691 A1* 10/2002 Sato et al. ..... 345/212

* cited by examiner

*Primary Examiner*—Richard Hjerpe
*Assistant Examiner*—Leonid Shapiro
(74) *Attorney, Agent, or Firm*—Troxell Law Office PLLC

(57) ABSTRACT

A method of driving an active matrix liquid crystal display (AM-LCD) is provided. The AM-LCD has a plurality of unit pixels arranged in array form, and each the unit pixel has a pixel electrode, an opposite common electrode, and a liquid crystal layer disposed therebetween. The method comprises the following steps. First, an alternating voltage signal V(n) with a selected gray level n is applied to the pixel electrode. A first compensated voltage signal V'(n) is applied to the pixel electrode simultaneously to compensate the alternating voltage signal V(n) for the potential level shift induced by the parasitic capacitance and the coupling capacitance of the unit pixel. A second compensated voltage signal Vasy(n) is applied to the pixel electrode simultaneously to compensate the alternating voltage signal V(n) for the potential level shift induced by the different material or the asymmetric appearance of the pixel electrode and the common electrode.

18 Claims, 3 Drawing Sheets

METHOD OF DRIVING ACTIVE MATRIX LIQUID CRYSTAL DISPLAY FOR RESTRAINING IMAGE STICKING

FIELD OF THE INVENTION

The present invention relates to a method of driving liquid crystal displays, and more specifically, to a method of adjusting the alternating data voltages of pixel units for controlling the direct levels of the alternating data voltages, so as to effectively reduce the residual direct voltage suffered in the liquid crystal layer for avoiding of image sticking.

BACKGROUND OF THE INVENTION

With rapid advancement of the fabrication technology of a thin film transistor liquid crystal display (TFT-LCD), the LCD is largely applied in various electronic products such as a Personal Digital Assistant (PDA) device, a notebook computer, a digital camera, a video camera, and a mobile phone due to the fact it has advantages of smaller size, less weight, lower power consumption and low radiation. Moreover, the quality of the LCD is ceaselessly improved and the price thereof is continuously decreased since manufacturers aggressively invest in research & development and employ large-scale fabricating equipment. That promptly broadens the applied fields of the LCD.

Please refer to FIG. 1, the circuit structure of the unit pixel is shown. The unit pixel is switched on or off by a thin film transistor (TFT) 10. The gate and source of the TFT 10 are connected separately to a scan line and a data line, and the drain thereof is connected with a storage capacitor Cst and a pixel electrode. When the TFT 10 is turned on by the scan signals, the data signals from the source can be transferred via the drain to the pixel electrode, and next be applied to the liquid crystal layer 12 so as to produce desired images.

In general, in the process of fabricating the LCDs, some bits and small pieces, such as ion particles, maybe fall and attach on the surfaces of the liquid crystal layer or the alignment films. Therefore, when the two sides of the liquid crystal layer are applied with a direct voltage for a period of time, the ion particles will be attracted by the voltage difference, so as to accumulate on the surfaces of the alignment films disposed on two sides of the liquid crystal layer. And after the direct voltage applied to the liquid crystal layer is removed, the accumulated ion particles on the alignment films still can produce an interior direct voltage remained in the liquid crystal layer for a long time, thereby causing the severe problems of image sticking.

For solving the aforementioned image sticking issues caused by driving the LCDs with the direct voltages, the LCDs at present are driven by alternating voltage sources. However, it is noted that, affected by the parasitic capacitance and the coupling capacitance in the unit pixel, some residual direct voltage still occurs across the two sides of the liquid crystal layer, even though applying the alternating voltage to drive it. Please refer to FIG. 2, the waveform of each terminal of the TFT 10 in the unit pixel is illustrated. When the scan signal Vg on the gate is a high level signal Vgh, the TFT 10 is turned on. Oppositely, when the scan signal Vg is a low level signal Vgl, the TFT 10 will be turned off. Following the operations of turning on and off the TFT 10, the data signals on the drain will appear polarity reversing due to the usage of alternating voltage source.

However, it is noted that, due to the affections of the parasitic capacitor (Cgd) between the gate and the drain, the storage capacitor (Cst), and the capacitor (Clc) of liquid crystal layer, the data signal Vdata transferred to the drain usually has a potential shift of ΔV(Cgd, Cst, Clc). As shown in FIG. 2, no matter what the potential level the signal Vs has, the potential level of the data signal Vdata always has a decrement ΔV, thereby causing a direct voltage effect for the unit pixel. Especially, for the various data signals with different gray levels, the potential shifts thereof are all different too, so the direct voltages effects thereof also differ.

Please refer to FIG. 3, the potential shifts of alternating data voltage signals with different gray levels are illustrated. In the case of the data signals with 256 gray levels, the signal waveforms of level 0, level 63, level 127, level 191, and level 255 are shown. Apparently, except the data signal of level 127, most data signals with other gray levels have asymmetric waveforms due to the potential shift ΔV, thereby causing the direct voltage effects in the liquid crystal layer. For solving this issue, a gamma correction circuit is introduced to produce additional compensated voltages according to different gray levels for adjusting the potential levels of the alternating data signals.

As shown in FIG. 3, compared to the original voltage level Vcdc of common electrode, disposed on another side of the liquid crystal layer opposite to the pixel electrode, the data signals Vdata provided is equal to Vcdc±V(0)+V'(0), wherein V(0) is the alternating data signal of level 0, and V'(0) is the compensated voltage signal of level 0. Thus, by adding the gamma correction voltage V'(0) for adjusting the level of the common electrode, the direct voltage level of level 0 is adjusted to Vcdc+V'(0), so as to avoid of affections of the residual direct voltage. Besides, as aforementioned, each data signal with one specific gray level has one different potential shift ΔV, so the necessary gamma correction voltage signals V'(0), V'(63), V'(191) and V'(255) are all different. And in the case of the data signal of level 127, because it has no potential shift, no additional gamma correction item is applied.

However, it is noted that, nowadays, for promoting the displaying performance of the LCDs, in the display panels the electrodes or alignment films disposed on two sides of the liquid crystal layer usually are designed with-different appearances or formed of different material. The typical design, such as Reflective Liquid Crystal Displays (RLCD), Multi-Domain Vertical Alignment LCDs (MVA-LCD), protrusion-slit type LCDs or hybrid-aligned nematic LCDs (HAN-LCD), etc., all have the asymmetric shaped or different material of electrodes and alignment films. Therefore, for these LCDs, the trapping ratios of ion particles are different on two sides of the liquid crystal layer, thereby causing severe "residual direct voltage" and "image sticking" problems. Under this condition, how to overcome the above issues becomes an important research topic at present.

SUMMARY OF THE INVENTION

A method of driving an active matrix liquid crystal display (AM-LCD) is disclosed in the present invention. The AM-LCD has a plurality of unit pixels arranged in array form, and each the unit pixel has a pixel electrode, an opposite common electrode, and a liquid crystal layer disposed there between. The method comprises the following steps. First, an alternating voltage signal V(n) with a selected gray level n is applied to the pixel electrode. A first compensated voltage signal V'(n) is applied to the pixel electrode simultaneously to compensate the alternating voltage signal V(n) for the potential level shift induced by the parasitic capacitance and the coupling capacitance of the unit pixel. A second compensated voltage signal Vasy(n) is applied to the pixel electrode simultaneously to compensate the alternating voltage signal V(n) for the potential level shift induced by the different material or the asymmetric appearance of the pixel electrode and the common electrode.

The above alternating voltage signal can be divided into n+1 sorts and be represented as V(0), V(1), V(2) . . . V(n) depending on different gray levels. As to the first compensated voltage signal V'(n) can also be divided into n+1 sorts and be represented as V'(0), V'(1), V'(2) . . . V'(n). When level 0 is the highest gray level and level n is the lowest gray level, the first compensated voltage signal conform to V'(0) >V'(1)> . . . >V'((n−1)/2)≈0>V'(n−1)>V'(n), where V'(0) <500 mV and V'(n)>−500 mV.

The aforementioned second compensated voltage signal can be divided into n+1 sorts and be represented as Vasy(0), Vasy(1), Vasy(2) . . . Vasy(n) basing on different gray levels. And when the second compensated voltage signal satisfies Vasy(0)>Vasy(1)> . . . >Vasy(n−1)>Vasy(n)>0, the second compensated voltage signal of level 0 conforms to Vasy(0) <500 mV. On the contrary, when the second compensated voltage signal satisfies Vasy(0)<Vasy(1)< . . . <Vasy(n−1) <Vasy(n)<0, the second compensated voltage signal of level 0 conforms to Vasy(0)>−500 mV.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
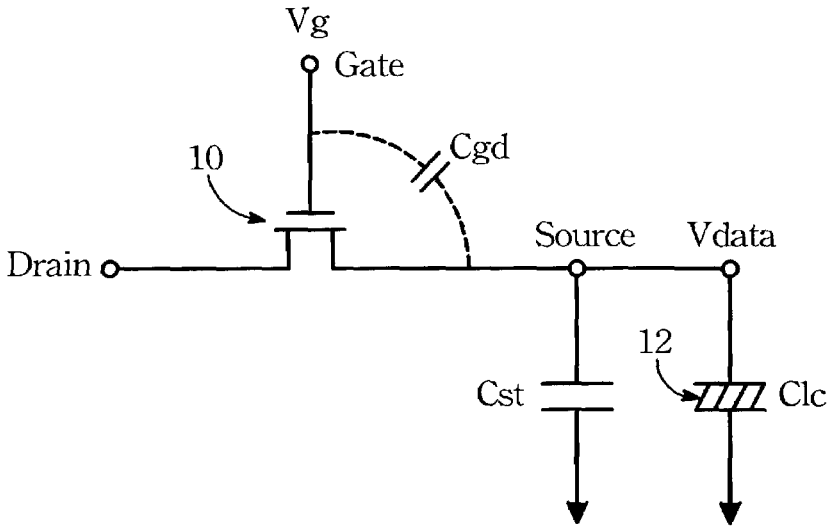
FIGURE 1 ( Prior Art )
FIG. 1 illustrates the circuit structure of the unit pixel of the LCD in prior art.
Figure 2:
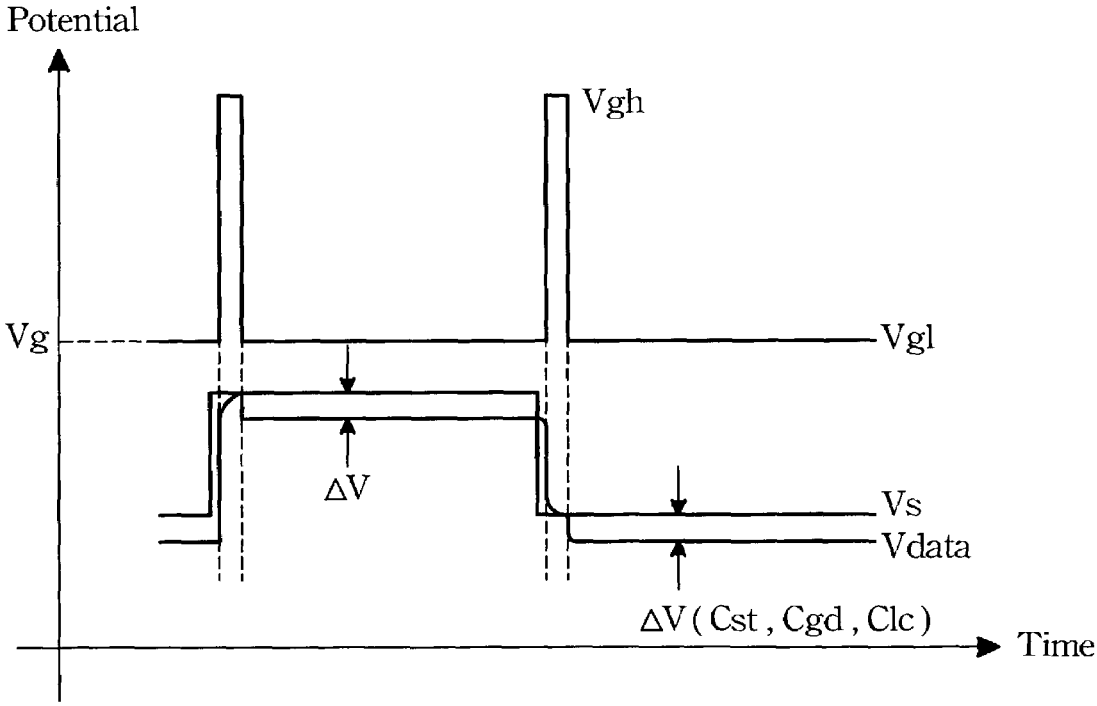
FIGURE 2 ( Prior Art )
FIG. 2 illustrates the waveforms of each terminal of the TFT in the unit pixel in prior art.
Figure 3:
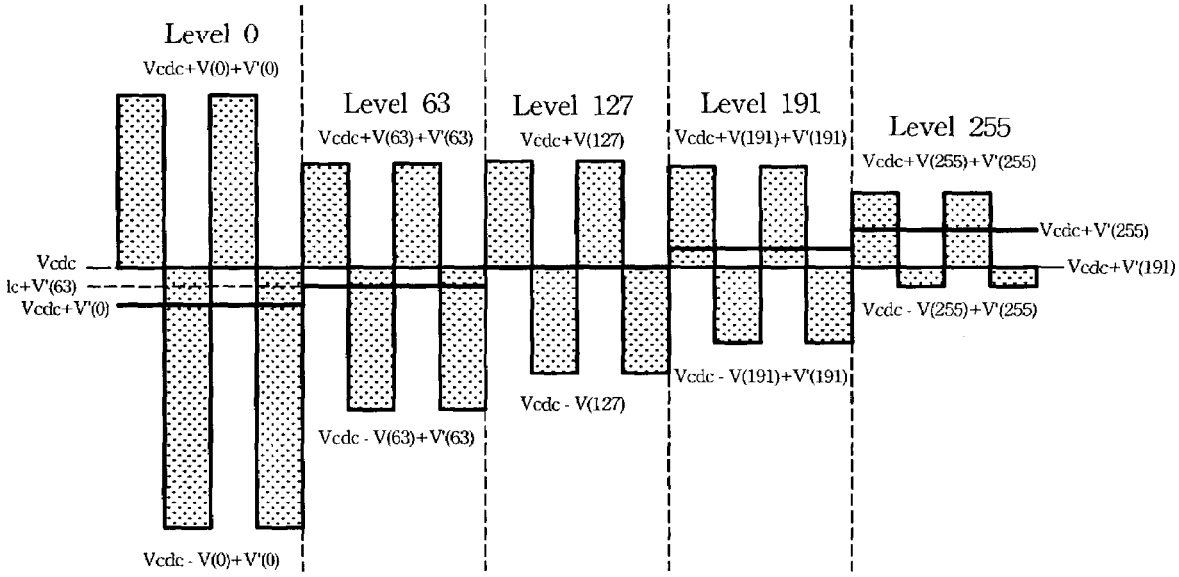
FIGURE 3 ( Prior Art )
FIG. 3 illustrates the potential shift of the alternating voltage signals with different gray levels of the LCD in prior art.
Figure 4:
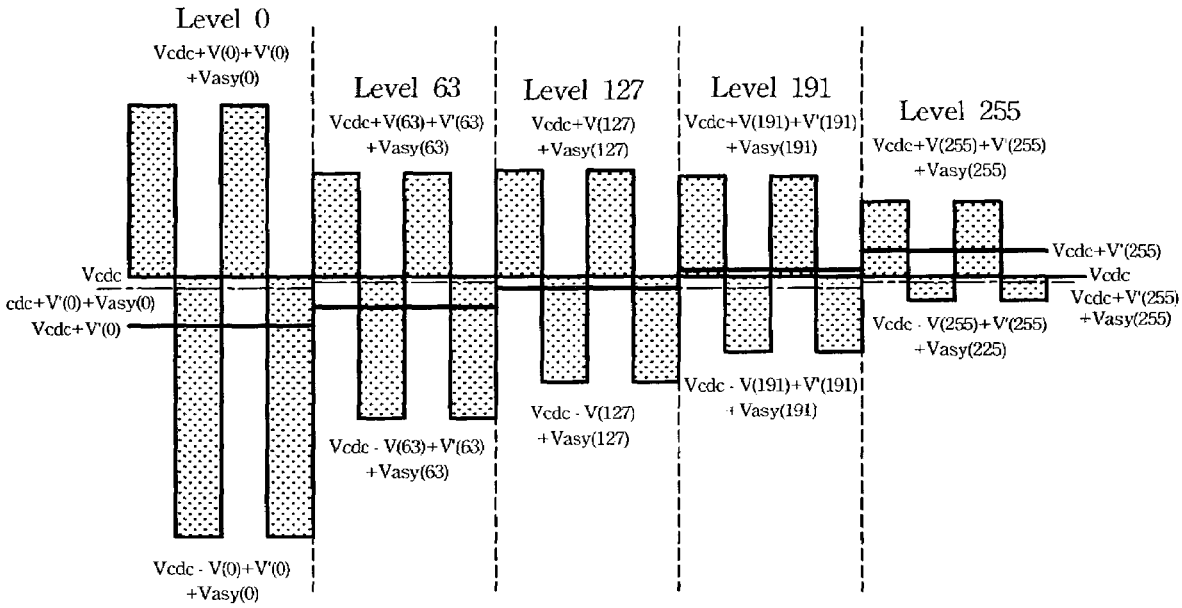
FIG. 4 illustrates the potential shift of the alternating voltage signals with different gray levels of the LCD according to the present invention.

The present invention provides a method of driving an active matrix liquid crystal display (AM-LCD). The AM-LCD has a plurality of unit pixels arranged in array form, and each the unit pixel has a pixel electrode, an opposite common electrode, and a liquid crystal layer disposed there between. According to the method of the present invention, the pixel electrode is firstly applied with an alternating voltage signal V(n) of a specific gray level. In the case of the alternating voltage signal with 256 gray levels, each gray level oaf voltage signal is illustrated in FIG. 4 as V(0), V(63), V(127), V(191) and V(255), appearing the trend of decreasing progressively. Namely, level 0 is the highest gray level here, and level 255 is the lowest gray level.

It is noted that, on the two sides of the liquid crystal layer the pixel electrode and the common electrode are disposed separately, and the common signal on the common electrode has the direct voltage of Vcdc, so the basic potential level of the pixel electrode is set with Vcdc, as shown in FIG. 4.

When the pixel electrode of the unit pixel is applied with an alternating data voltage Vdata, the voltage signal of Vcdc±V(n) is applied to produce the image with gray level n. However, as aforementioned, the parasitic capacitor Cgd occurring between the gate and the drain of TFT in the unit pixel will couple with the storage capacitor Cst and the liquid crystal layer capacitor Clc, thereby leading an additional direct voltage due to the coupling capacitance. Therefore, in the mean time of applying the above voltage signal with selected gray level, a first compensated voltage signal V'(n) is applied to the pixel electrode. Because each gray level of alternating data voltage signal needs different first compensated voltage signal, the first compensated voltage signal is set to vary according to different gray levels, so as to correct the potential shift induced by the parasitic capacitance and the coupling capacitance of the unit pixel.

Please refer to FIG. 4, because the potential shift caused by the alternating data voltage signal of level 0 is most severe, the required first compensated voltage signal V'(0) is also largest. And because the leading direct voltage is added to the potential level of Vcdc and promotes the basic potential level, the V'(0) is set to be a negative value for adjusting downwardly the data signal level of the pixel electrode with a decrement V'(0). Similarly, for the alternating data voltage signal of level 63, its original potential level is too high, so the required first compensated voltage signal V'(63) is also a negative value for lowering the basic potential level thereof. As to the alternating data voltage signals of level 191 and level 255, the leading direct voltage will lower their basic potential levels, so the required first compensated voltage signals V'(191) and V'(255) both are positive, so as to promote the basic potential levels thereof.

In other words, when the gray levels of voltage signals have n+1 sorts and are represented as V(0), V(1), V(2) . . . V(n), the first compensated voltage signals also have n+1 sorts and are divided into V'(0), V'(1), V'(2) . . . V'(n) basing on different gray levels. Further, when V(0) is the voltage signal with the highest gray level and V(n) is the voltage signal with the lowest gray level, the first compensated voltage signals conform to the equation of V'(0)>V'(1)> . . . >V'((n−1)/2)=0>V'(n−1)>V'(n). In the case of the voltage signals with 256 different gray levels, as shown in FIG. 4, those first compensated voltage signals conform to V'(0)>V'(63)>V'(127)≈0>V'(191)>V'(255).

Except the compensation for the leading voltage induced by the parasitical capacitance and the coupling capacitance of the unit pixel, the pixel electrode and the common electrode, disposed on the two sides of the liquid crystal layer, still have different trapping ratios for the ion particles in the liquid crystal layer, due to asymmetric shapes and different material of the electrodes or the alignment films, thereby causing additional direct voltage. Therefore, when applying the gray level of voltage signal, a second compensated voltage signal Vasy(n) is also applied to the pixel electrode. The second compensated voltage signal Vasy(n) varies depending on different gray levels, so as to compensate the potential shift caused by the asymmetric shapes or different material.

In a preferred embodiment, when the gray level of voltage signals has n+1 sorts and are represented as V(0), V(1), V(2) . . . V(n), the second compensated voltage signals also have n+1 sorts and are divided into Vasy(0), Vasy(1), Vasy(2) . . . Vasy(n) basing on different gray levels. Further, when V(0) is the highest gray level of voltage signal and V(n) is the lowest gray level of voltage signal, the second compensated voltage signals conform to the equation of Vasy(0)>Vasy(1)> . . . >Vasy((n−1)/2)> . . . >Vasy(n−1) >Vasy(n). In the case of the voltage signals with 256 different gray levels, as shown in FIG. 4, those second compensated voltage signals conform to Vasy(0)>Vasy(63) >Vasy(127)>Vasy(191)>Vasy(255)>0.

It is noted that, in the above embodiment, the second compensated voltage signal Vasy(n) is larger than 0, so as to adjust the direct voltage with lower potential level. However for the direct voltage with higher potential level, the applying second compensated voltage signal Vasy(n) is less than 0. At this time, if the V(0) is the highest gray level of voltage signal and V(n) is the lowest gray level of voltage signal, the second compensated voltage signal conforms to Vasy(0) <Vasy(1)< . . . <Vasy((n−1)/2)< . . . <Vasy(n−1)<Vasy(n)<0. In the case of the voltage signals with 256 different gray levels, those second compensated voltage signals conform to Vasy(0)<Vasy(63)<Vasy(127)<Vasy(191)<Vasy(255)<0.

Figure 5:
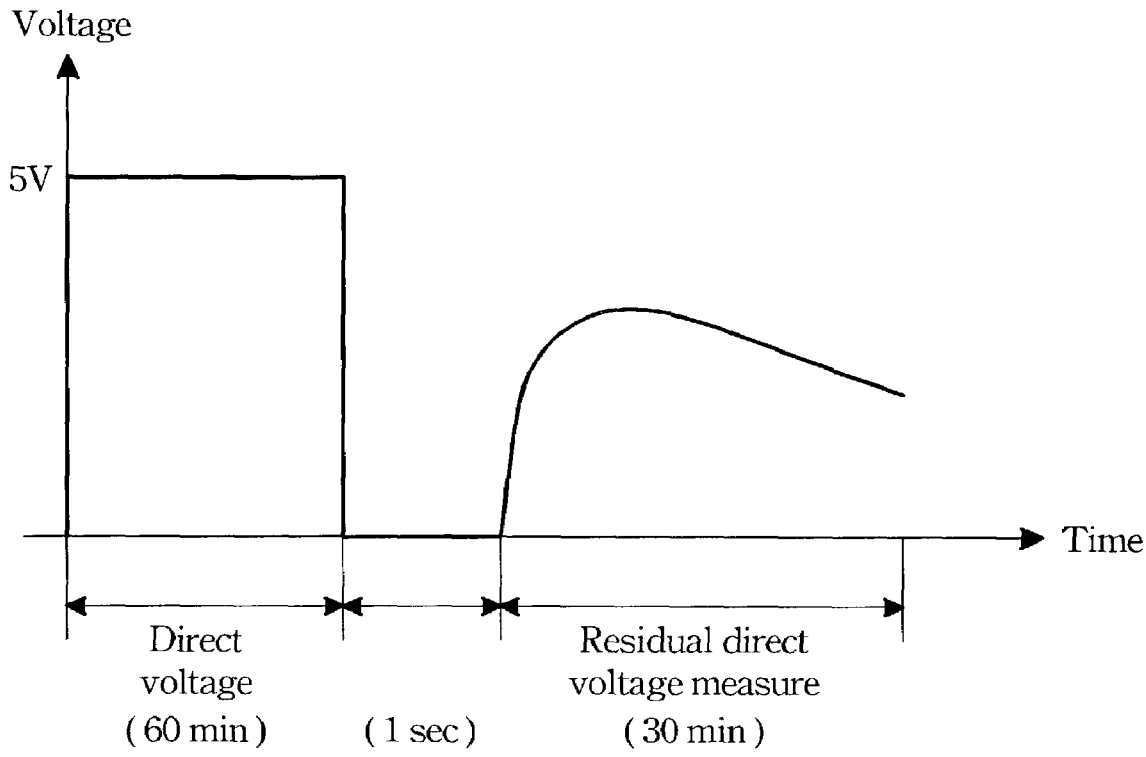
FIG. 5 illustrates the measurement of residual direct voltage after the liquid crystal layer is applied with a direct voltage for one hour according to the present invention.
Figure 6:
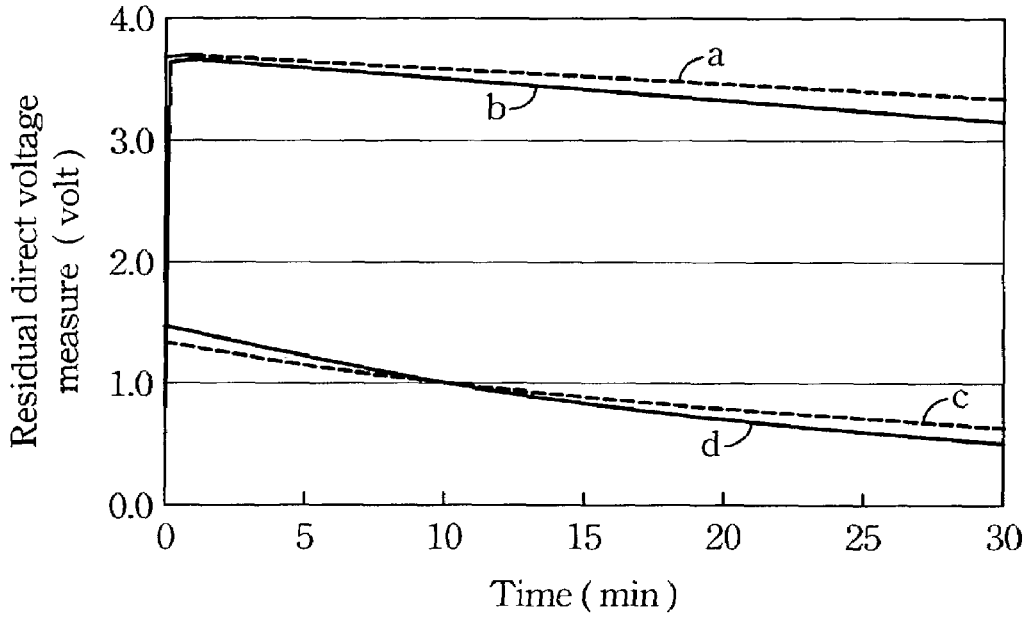
FIG. 6 illustrates the measurement of residual direct voltage when the liquid crystal layer with different material of electrodes disposed formed thereon is applied with positive or negative direct voltages.

The present invention also provides a method to decide the values of the second compensated voltage signal Vasy (n). Please refer to FIG. 5, the first step is to measure the residual direct voltages of the liquid crystal layer. The measuring manner is applying 5 volts of direct voltage to the liquid crystal layer about 60 minutes firstly, and next measuring the residual direct voltage of the liquid crystal layer after removing the direct power source of 5 volts. Please refer to FIG. 6, when the positive electrode and the negative electrode disposed on two sides of the liquid crystal layer are made of ITO and aluminum separately, after applying the direct voltage +5 volts about 60 minutes, the value of the residual direct voltage is about 3.5 volts, as the lines a & b shown in FIG. 6 which represent two sets of data. On the contrary, if the positive electrode is made of Al and the negative electrode is made of ITO, after applying the direct voltage of +5 volts about 60 minutes, there is about 1.5 volts of residual direct voltage, as the lines c & d shown in FIG. 6 representing two sets of data separately.

It is noted that when the measuring step is performed and lasting about 27 minutes, the difference of two the residual direct voltages induced by applying +5 volts as aforementioned is about 3.0 volts. According to this difference value, the second compensated voltage Vasy(n) can be estimated precisely.

In the case of normally white mode, the feedthrough voltage has a difference of 0.5~1.0 volts between the gray level 0 (black) and gray level 255 (white). Therefore, a half of this difference, about 0.25~0.50 volts, can be applied as an absolute value of the possible residual direct voltage suffered the images of level 0 to level 255 of the LCDs with different material of or asymmetric shaped electrodes. Accordingly, a equation is shown as:

$$(3V/5V)*0.25V\sim0.5V=150\text{ mV}\sim300\text{ mV}$$

wherein 3V is the largest difference of the residual direct voltages induced by applying +5V direct power sources for one hour. Thus, for the typical TFT LCDs, the residual voltage difference between level 0 and level 255 is about 150 mV~300 mV.

However, if the direct voltage is applied for 10 hours or the pixel electrode and the common electrode are more asymmetrical, such as both different material and appearance, the residual direct voltage will have larger value. So the limited maximum of the residual direct voltage is set as 500 mV, namely Vasy<500 mV.

In a preferred embodiment, when the first compensated voltage signal meets V'(0)>V'(63)>V'(127)≈0>V'(191)>V' (255), let V'(0)<500 mV and V'(255)>−500 mV. And when the second compensated voltage signal meets Vasy(0)>Vasy (63)>Vasy(127)>Vasy(191)>Vasy(255)>0, let Vasy(0)<500 mV. On the contrary, when the second compensated voltage signal meets Vasy(0)<Vasy(63)<Vasy(127)<Vasy(191) <Vasy(255)<0, let Vasy(0)>−500 mV.

Due to the consideration for the asymmetry of material and appearance of the pixel and common electrodes, in the present invention, the second compensated voltage signal Vasy is introduced to reduce the affection of residual direct voltage. So the driving method provided in the present invention can effectively applied to various LCDs with different material or shapes of electrodes, such as reflective liquid crystal displays, multi-domain vertical alignment LCDs, protrusion-slit type LCDs, or hybrid-aligned nematic LCDs and etc., so as to overcome the issue of residual direct voltage induced by ion particles accumulation.

As is understood by a person skilled in the art, the foregoing preferred embodiment of the present invention is illustrated of the present invention rather than limiting of the present invention. It is intended to cover various modifications and similar arrangements included within the spirit and scope of the appended claims, the scope of which should be accorded the broadest interpretation so as to encompass all such modifications and similar design.

What is claimed is:

1. A method of driving an active matrix liquid crystal display (AM-LCD), wherein said AM-LCD has a plurality of unit pixels arranged in array form, and each said unit pixel has a pixel electrode, an opposite common electrode, and a liquid crystal layer disposed there between, said method comprising the following steps:

applying a alternating voltage signal V(n) with a selected gray level n to said pixel electrode;

simultaneously applying a first compensated voltage signal V'(n) to said pixel electrode, wherein said first compensated voltage signal V'(n) varies depending on said alternating voltage signal V(n) with said selected gray level n to compensate said alternating voltage signal V(n) for the potential shift induced by the parasitic capacitance and the coupling capacitance of said unit pixel; and simultaneously applying a second compensated voltage signal Vasy(n) to said pixel electrode, wherein said second compensated voltage signal Vasy(n) varies depending on said alternating voltage signal V(n) with said selected gray level n to compensate said alternating voltage signal V(n) for the potential shift induced by the different material or the asymmetric appearance of said pixel electrode and said common electrode, wherein said second compensated voltage signal has n+1 sorts and can be divided basing on different pray levels into Vasy(0). Vasy(1), Vasy(2), Vasy(n).

2. The method of claim 1, wherein said alternating voltage signal (V)(n) has n+1 sorts and can be divided basing on different gray levels into (V)(0), (V)(1), (V)(2) . . . (V)(n).

3. The method of claim 1, wherein said first compensated voltage signal V'(n) has n+1 sorts and can be divided basing on different gray levels into V'(0), V'(1), V'(2) . . . V'(n).

4. The method of claim 3, wherein said first compensated voltage signal V'(n) conforms to V'(0)>V'(1)> . . . V'((n−1)/2)=0>V'(n−1)>V'(n) when said V'(0) has the highest gray level.

5. The method of claim 4, wherein said first compensated voltage signal V'(n) conforms to V'(0)<500 mV and V'(n) >−500 mV.

6. The method of claim 4, wherein said second compensated voltage signal conforms to Vasy(0)>Vasy(1)> . . . >Vasy(n−1)>Vasy(n)>0.

7. The method of claim 6, wherein said second compensated voltage signal conforms to Vasy(0)<500 mV.

8. The method of claim 4, wherein said second compensated voltage signal conforms to Vasy(0)<Vasy(1)< . . . <Vasy(n−1)<Vasy(n)<0.

9. The method of claim 8, wherein said second compensated voltage signal conforms to Vasy(0)>−500 mV.

10. A method of adjusting an alternating data voltage signal of an active matrix liquid crystal display (AM-LCD) for preventing from image sticking, wherein said AM-LCD has a plurality of unit pixels arranged in array form, and each said unit pixel has a pixel electrode, an opposite common electrode, and a liquid crystal layer disposed there between, said method comprising the following steps:

applying an alternating data voltage signal V(n) with a selected gray level n to said pixel electrode; and adding a compensated voltage signal Vasy(n) to said alternating data voltage signal V(n), wherein said compensated voltage signal Vasy(n) varies depending on said selected gray level n to compensate said alternating data voltage signal V(n) for the potential shift induced by the different material or the asymmetric appearance of said pixel electrode and said common electrode, wherein said compensated voltage signal Vasy(n) has n+1 sorts and can be divided basing on different pray levels into Vasy(0), Vasy(1), Vasy(2) . . . Vasy(n).

11. The method of claim 10, further comprising the step of:

adding a gamma correction voltage signal V'(n) produced by a gamma connection circuit to said alternating data voltage signal V(n), wherein said gamma correction voltage signal V'(n) depending on said selected gray level n is applied to compensate said alternating data voltage signal V(n) for the potential shift induced by induced by the parasitic capacitance and the coupling capacitance of said unit pixel.

12. The method of claim 11, wherein said gamma correction voltage signal V'(n) has n+1 sorts and can be divided basing on different gray levels into V'(0), V'(1), V'(2) . . . V'(n).

13. The method of claim 12, wherein said gamma correction voltage signal conforms to V'(0)>V'(1)> . . . V'((n−1)/2)≈0>V'(n−1)>V'(n) when said V'(0) has the highest gray level 0 and V'(n) has the lowest gray level n.

14. The method of claim 13, wherein said gamma correction voltage signal conforms to V'(0)<500 mV and V'(n) >−500 mV.

15. The method of claim 13, wherein said compensated voltage signal conforms to Vasy(0)>Vasy(1)> . . . >Vasy(n−1)>Vasy(n)>0.

16. The method of claim 15, wherein said compensated voltage signal conforms to Vasy(0)<500 mV.

17. The method of claim 13, wherein said compensated voltage signal conforms to Vasy(0)<Vasy(1)< . . .<Vasy(n−1)<Vasy(n)<0.

18. The method of claim 17, wherein said compensated voltage signal conforms to Vasy(0)>−500 mV.

* * * * *